US005572991A

United States Patent [19]

Grilliot et al.

[11] Patent Number: 5,572,991

[45] Date of Patent: Nov. 12, 1996

[54] AIR FLUSH SYSTEM FOR A FIREFIGHTER'S GARMENT

[75] Inventors: William L. Grilliot; Mary I. Grilliot, both of West Milton, Ohio

[73] Assignee: Morning Pride Mfg. Inc., Dayton, Ohio

[21] Appl. No.: 303,467

[22] Filed: Sep. 9, 1994

[51] Int. Cl.[6] ..... A62B 17/00

[52] U.S. Cl. ..... 128/201.29; 128/204.15

[58] Field of Search ..... 128/201.25, 201.29, 128/202.11, 202.14, 204.15

[56] References Cited

U.S. PATENT DOCUMENTS

| | | | |
|---|---|---|---|
| 642,166 | 1/1900 | Sherman . | |
| 2,335,474 | 11/1943 | Beall | 128/202.11 |
| 2,404,020 | 7/1946 | Akerman | 128/202.11 |
| 2,966,155 | 12/1960 | Krupp | 128/202.11 |
| 3,049,896 | 8/1962 | Webb . | |
| 3,292,179 | 12/1966 | Iacono, Jr. et al. . | |
| 3,559,642 | 2/1971 | Cupp | 128/201.29 |
| 3,667,460 | 6/1972 | Shepard | 128/202.11 |
| 4,095,593 | 6/1978 | Webbon et al. | 128/202.11 |
| 4,881,539 | 11/1989 | Pasternack | 128/202.11 |
| 4,897,886 | 2/1990 | Grilliot et al. | 2/81 |
| 5,001,783 | 3/1991 | Grilliot et al. | 2/81 |
| 5,131,097 | 7/1992 | Grilliot et al. | 2/81 |

OTHER PUBLICATIONS

Chem–Tex brochure "BE COOL!".

*Primary Examiner*—Aaron J. Lewis
*Attorney, Agent, or Firm*—Rockey, Rifkin and Ryther

[57] ABSTRACT

The invention consists of a firefighter's garment in which the exhaled air or other gas from the firefighter's SCBA (self-contained breathing apparatus) is delivered to the air space between adjacent layers of the garment. The relatively cool exhaled air is forced under pressure into the garment's air space to cool garment and lower the heat stress on the firefighter. In the preferred embodiment, the garment includes spacer elements extending the length of the coat located between adjacent layers to create channels into which the exhaled air is forced. The spacer elements maintain spacing between the adjacent layers facilitating the flow of air through the garment. Alternatively, the air or other gas can be delivered to the garment from a canister or directly from the SCBA.

58 Claims, 2 Drawing Sheets

AIR FLUSH SYSTEM FOR A FIREFIGHTER'S GARMENT

BACKGROUND OF THE INVENTION

The invention relates, generally, to firefighters' garments and, more particularly, to an air flush system for such garments.

Firefighters' garments such as jackets and pants typically consist of an outer layer of abrasion resistant and flame retardant material such as NOMEX™. Inside of the outer shell is a moisture barrier of neoprene or other similar material that extends throughout the outer shell and a thermal barrier consisting of one or more layers of NOMEX™, or other similar heat-insulating material.

The moisture barrier and thermal barrier are secured within the outer shell in a variety of ways. For example, these layers can be permanently or releasably secured within the outer shell and can be secured to one another along their respective edges. One method of construction is disclosed in U.S. Pat. No. 5,001,783 issued to Grilliot et al. The garment disclosed in this patent includes a plurality of spacer elements creating a series of channels between two of the layers of material to maintain a dead air space between the layers for enhancing the insulating characteristics of the garment. Regardless of the specific construction of the garment, most firefighter garments have a plurality of layers.

As will be appreciated, firefighters are exposed to intense heat and are involved in extremely strenuous physical activities. As a result, overheated air and hot vapors will become trapped in the air space between the layers of the garment. As the vapors and air in the coat heat up and accumulate, tremendous stress is placed on the firefighter that can cause physical problems such as heat exhaustion, dehydration and the like. Moreover, the hot air and vapor trapped between the layers lowers the thermal insulation or TPP (Thermal Protective Performance) of the garment thereby increasing the risk of injury from exposure to the heat of a fire.

Thus, a system for flushing the air trapped between the layers in a firefighter's garment is desired.

SUMMARY OF THE INVENTION

The invention consists of a firefighter's garment in which in a preferred embodiment the exhaled air from the firefighter's SCBA (Self-Contained Breathing Apparatus) is delivered to the air space or channels between adjacent layers of the garment. The relatively cool exhaled air is forced under pressure into the garment's air space to cool the garment and lower the heat stress on the firefighter. In the preferred embodiment, the garment includes spacer elements extending the length of the coat located between adjacent layers to create channels into which the exhaled air is forced. The spacer elements maintain spacing between the adjacent layers and provide pathways for the air facilitating the flow of air through the garment. It is further contemplated that the air introduced into the garment be supplied directly from the SCBA storage tank or be supplied from a separate canister carried by the firefighter.

DETAILED DESCRIPTION OF THE INVENTION

Figure 1:
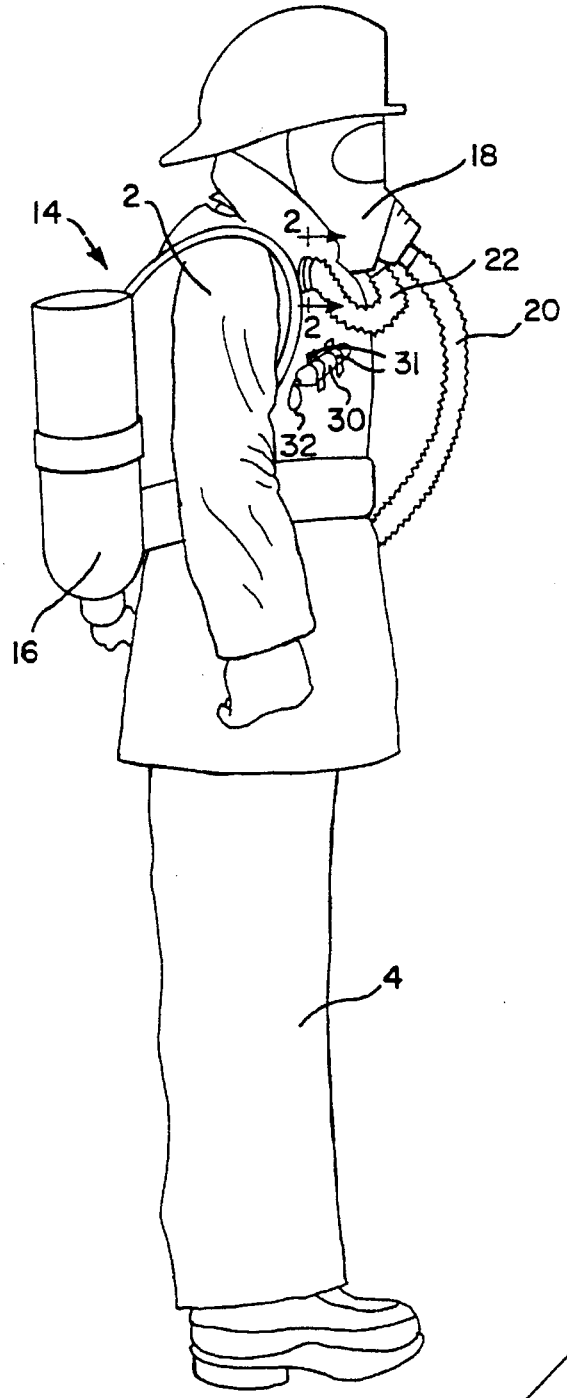
FIG. 1 is a view of a firefighter wearing the air flush system of the invention.
Figure 2:
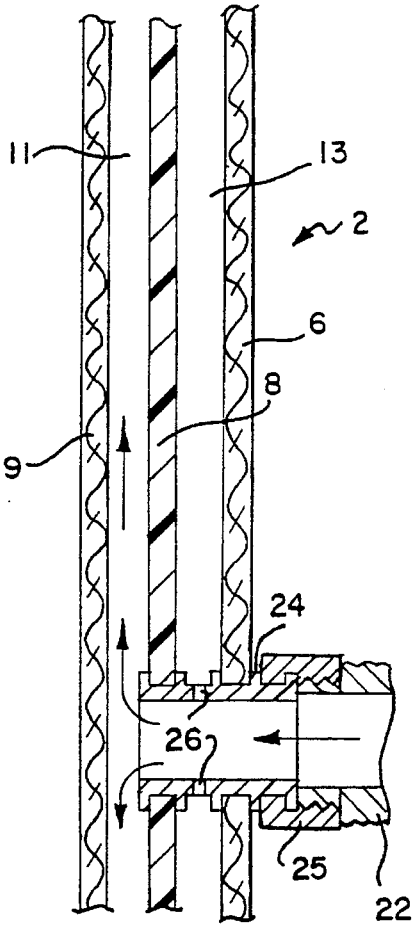
FIG. 2 is a detailed view of the air flush system of FIG. 1.

Referring more particularly to FIG. 1, a typical firefighter outfit is illustrated consisting of a jacket 2 and pants 4. The Jacket and pants are, in a preferred embodiment, constructed of an outer shell 6 of abrasive and flame resistant material, a moisture barrier 8 of neoprene or other similar waterproof material and a thermal liner 9 of NOMEX™ or other similar high temperature thermal insulative material, as best shown in FIG. 2. Air spaces 11 and 13 are created between the various layers and provide added thermal protection for the firefighter. While a three layer garment is illustrated, it will be appreciated that a garment having a fewer or greater number of layers can be used with the air flush system of the invention. For example, the thermal barrier can consist of two layers such as batting material covered with a face cloth. As will be apparent, where a greater number of layers are used, a greater number of air spaces are created therebetween.

Figure 3:
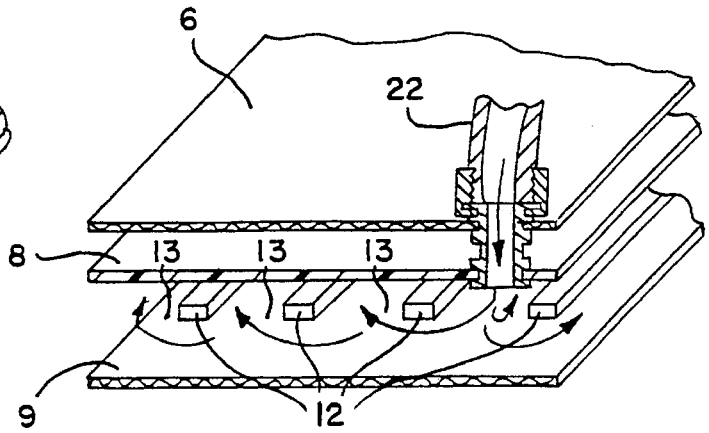
FIG. 3 is a view of a preferred construction for a garment used in the air flush system of the invention.

In a preferred embodiment, channels 10 are created between two adjacent layers of material by securing spacer elements 12 between the layers that extend the length of the garment as best shown in FIG. 3. U.S. Pat. Nos. 4,897,886 and 5,001,783 disclose firefighter garments constructed with channels and are incorporated herein by reference. It is to be understood that the channels 10 can be created by any suitable method.

The typical firefighter's outfit further includes a SCBA or self-contained breathing apparatus 14 consisting of an air source typically in the form of a tank 16 holding a quantity of compressed air. Air from tank 16 is delivered to a face mask 18 via hose 20. Suitable valving and regulators (not shown) are provided to control the flow of air to the firefighter. A second line 22 delivers exhaled air from the face mask to the air space 11 between two adjacent layers of material as shown graphically by arrows in FIGS. 2 and 3. Specifically, hose 22 is releasably connected to a fitting 24 by locking nut 25. Fitting 24 communicates with air space 11 to deliver air to air space 11 as shown by the arrows in FIG. 2. It is further contemplated that apertures 26 be provided in the fitting 24 in the area of air space 13 to deliver a portion of the exhaled air to this air space as well. Apertures 26 can be eliminated if it is desired to provide the exhaled air only to a single air space.

Vent openings can be provided between adjacent layers of material to allow air to escape from between the adjacent layers. For example, the exhaled air can be introduced near the upper edge of coat 2 and vents (not shown) can be provided near the bottom edge and/or wrists of the garment. The use of the vents creates an air flow path through the garment and facilitates the flushing of the hot air and vapors from the garment.

While the fitting 24 is shown in FIG. 2 to deliver air between the different layers of the garment, it will be appreciated that the fitting could penetrate the thermal liner as well and deliver air to the interior of the garment. In this way the cool air can be delivered directly to the firefighter. It will be apparent that the cool air could be delivered to the interior of the garment and between the different layers of the garment.

The exhaled air is relatively cool when compared to the hot air and vapors that become trapped in a firefighter's garment. Thus, the introduction of the exhaled air to the garment will replace the hot vapor with relatively cool air thereby cooling the firefighter. Moreover, the air flow created in the garment will evaporate moisture trapped between the layers and the evaporation process will also cool the firefighter. The use of the air flush system of the invention can also significantly increase the TPP or thermal insulation of the garment by creating a relatively cool layer of insulating air in the garment.

Figure 4:
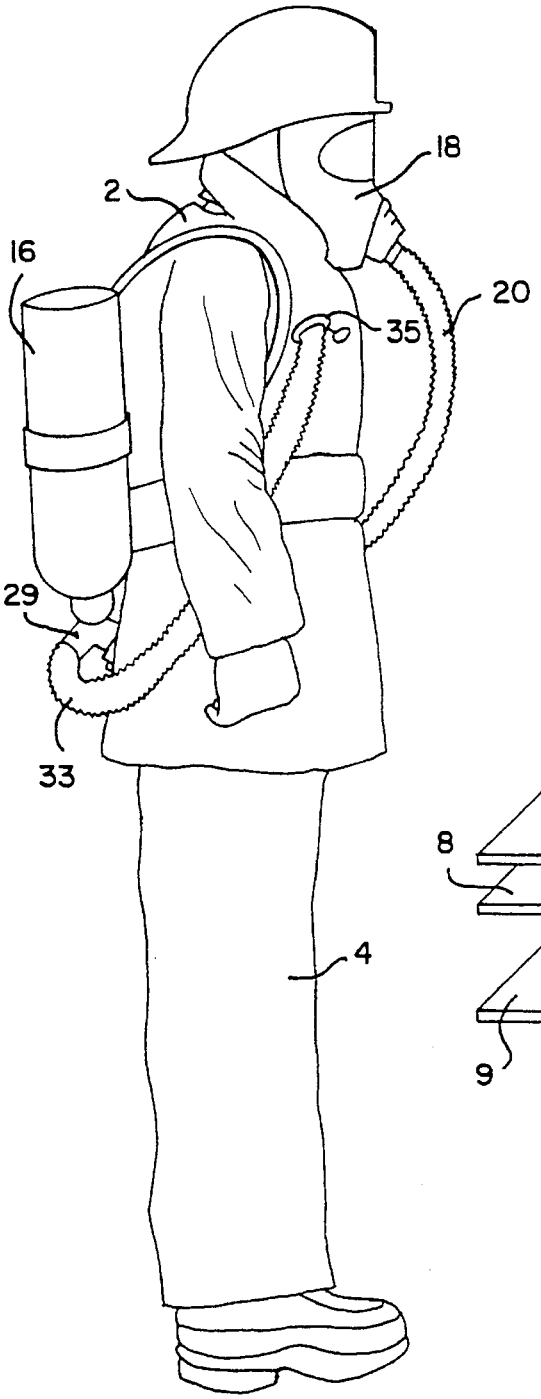
FIG. 4 is an alternate embodiment of the air flush system shown in FIG. 1.

An alternate embodiment of the invention is shown in FIG. 4 where the tank 16 is connected via Y-connector 29 to a first hose 20 and a second hose 33. First hose 20 is connected to and communicates with the face mask 18 for providing air to the firefighter. The second hose 33 is releasably connected directly to jacket 2 for delivering air directly from tank 16 to the air spaces of the garment. A valve 35 is provided to control the flow of air to the garment. In the preferred embodiment, valve 35 is manually controlled such that air will be provided to the garment only when desired by the firefighter. It is contemplated, however, that valve 35 can include a restricted orifice for continuously bleeding a small amount of air into the garment. It should also be noted that the manually controlled valve and restricted orifice could also be used together such that a small amount of air is continuously delivered to the garment and the manual valve can be opened to provide a greater amount of air.

Figure 5:
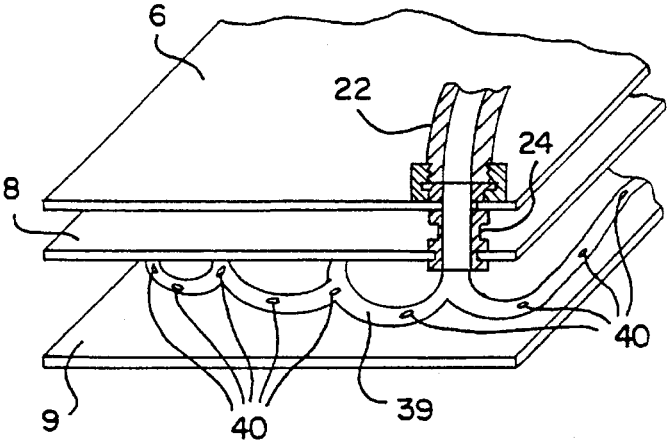
FIG. 5 is a modification of the air flush system of the invention.

Another alternate embodiment of the invention is shown in FIG. 5 where the channels 10 as shown in FIG. 3 are replaced by a flexible conduit 39 that is fixed to the source of air via fitting 24. Flexible conduit 39 extends throughout those areas of the garment where the effect of the air flush is desired and is provided with small holes 40 for delivering air to the garment. The flexible conduit can be fixed to one of the layers by adhesive or other suitable means to maintain the position of conduit 39 within the garment. Moreover, conduit 39 can be used in conjunction with the spacers of FIG. 3.

Referring to FIG. 1, it is further contemplated that a relatively small auxiliary source of compressed air such as canister 30 be fixed to the firefighter garment by any suitable releasable connector such as straps 31. Straps 31 can be releasably secured over the canister 30 by hook and loop fasteners, snaps or the like. Canister 30 is connected to the air space between adjacent layers of the garment in a manner similar to that for hose 22 as described with reference to FIG. 2. Such small canisters 30 are commonly found on life preservers or other flotation devices where the pulling of a ring or cord 32 opens a valve allowing the compressed air to be quickly expelled from canister 30. It is contemplated that auxiliary source 30 will be used by the firefighter in emergencies when under extreme heat loads. In such a situation, the firefighter can pull ring 32 to open canister 30 and rapidly flush the garment with air to provide a temporary increase in thermal protection and cooling in emergency situations.

While the flush system of the invention has been described specifically with respect to the firefighter's jacket 2, it will be appreciated that the flush system of the invention can be used to cool the firefighter's pants or other similar garment. Moreover, the separate canister 30 can be included on the pants 4 as well as the jacket 2 if desired. It is further contemplated that a gas other than air, such as $CO_2$ can be used if desired.

While the invention has been described in some detail with respect to the drawings, it will be appreciated that numerous changes in the details and construction of the invention can be made without departing from the spirit and scope of the invention as set forth in the appended claims.

What is claimed is:

1. A flush system for a protective garment adapted to be worn by a person, comprising:

(a) a garment having a plurality of layers, a space being located between two of the layers;

(b) a source of compressed gas carried by a person;

(c) means for delivering gas from the source to a face mask for inhalation by a person; and (d) means for delivering gas exhaled by a person from the mask directly to the space by way of a closed conduit.

2. The flush system according to claim 1, wherein said garment comprises a firefighter jacket.

3. The flush system according to claim 1, wherein said garment comprises firefighter pants.

4. The flush system according to claim 1, wherein said garment includes an outer shell of flame resistant and abrasion resistant material; a moisture barrier layer and a thermal barrier layer.

5. The flush system according to claim 4, wherein said space is located between the thermal barrier layer and moisture barrier layer.

6. The flush system according to claim 4, wherein said space is located between the outer shell and moisture barrier.

7. The flush system according to claim 1, wherein a plurality of spacer elements are located in said space to create channels within said space for receiving the exhaled gas.

8. The flush system according to claim 1, further including a hose located in said space for receiving the exhaled gas, said hose including at least one aperture for venting gas to said space.

9. The flush system according to claim 1, wherein vent means are provided to allow gas to escape from said space.

10. The flush system according to claim 9, wherein the means for delivering exhaled gas delivers gas at one end of the garment and the vent means is located at an opposite end of the garment to create gas flow through the garment.

11. The flush system according to claim 1, wherein the source of compressed gas is a self-contained breathing apparatus.

12. The flush system according to claim 1, wherein the means for delivering exhaled gas includes a flexible hose, said hose being releasably attached to the garment.

13. The flush system according to claim 1, wherein said garment includes a plurality of spaces located between adjacent ones of the plurality of layers, said means for delivering exhaled gas delivers gas to more than one of said plurality of spaces.

14. The flush system according to claim 1, further including a canister of compressed gas releasably mounted to the garment, said canister including means to open said canister and deliver the gas from the canister to said space during an emergency.

15. The flush system according to claim 1, wherein the gas is air.

16. The flush system according to claim 1, wherein the gas is $CO_2$.

17. An air flush system for a firefighter's garment adapted to be worn by a firefighter comprising:

(a) a jacket having an outer shell of flame resistant and abrasive resistant material, a moisture barrier layer and a thermal barrier layer, and an air space located between two of said layers;

(b) a source of compressed air carried by a firefighter;

(c) a face mask;

(d) means for delivering air from the source to the mask for inhalation by a firefighter; and (e) means for delivering air exhaled by a firefighter directly to the air space by way of a closed conduit.

18. The air flush system according to claim 17, wherein said air space is located between the thermal barrier layer and moisture barrier layer.

19. The air flush system according to claim 17, wherein a plurality of spacer elements are located in said air space to create channels within said air space for receiving the exhaled air.

20. The air flush system according to claim 17, wherein vent means are provided to allow air to escape from said air space.

21. The air flush system according to claim 20, wherein the means for delivering exhaled air delivers air at one end of the garment and the vent means is located at an opposite end of the garment to create air flow through the garment.

22. The air flush system according to claim 17, wherein the source of compressed air is a self-contained breathing apparatus.

23. The air flush system according to claim 17, wherein the means for delivering exhaled air includes a flexible hose, said hose being releasably attached to the garment.

24. The air flush system according to claim 17, wherein said garment includes a plurality of air spaces located between adjacent ones of the plurality of layers, said means for delivering exhaled air delivers air to more than one of said plurality of air spaces.

25. The air flush system according to claim 17, further including a canister of compressed air releasably mounted to the firefighter's garment, said canister including means to open said canister and deliver the air from the canister to said space during an emergency.

26. The air flush system according to claim 17, further including a hose located in said space for receiving exhaled air, said hose including at least one aperture for venting air into said space.

27. A flush system for a protective garment adapted to be worn by a person, comprising:

(a) a garment having a plurality of layers, a space being located between two of the layers;

(b) a source of compressed gas carried by a person;

(c) means for delivering gas from the source to a face mask for inhalation by a person;

(d) means for delivering gas exhaled by a person from the mask to the space; and (e) means for venting the gas from the space, wherein the means for delivering exhaled gas delivers gas at one end of the garment and the vent means is located at an opposite end of the garment to create gas flow through the garment.

28. The flush system according to claim 27 wherein said garment comprises a jacket.

29. The flush system according to claim 27 wherein said garment comprises pants.

30. The flush system according to claim 27, wherein said garment includes an outer shell of flame resistant and abrasion resistant material, a moisture barrier layer and a thermal barrier layer.

31. The flush system according to claim 30, wherein said space is located between the thermal barrier layer and moisture barrier layer.

32. The flush system according to claim 30, wherein said space is located between the outer shell and moisture barrier.

33. The flush system according to claim 27, wherein a plurality of spacer elements are located in said space to create channels within said space for receiving the exhaled gas.

34. The flush system according to claim 27, further including a hose located in said space for receiving the exhaled gas, said hose including at least one aperture for venting gas to said space.

35. The flush system according to claim 27, wherein said garment includes a plurality of spaces located between adjacent ones of the plurality of layers, said means for delivering exhaled gas delivers gas to more than one of said plurality of spaces.

36. The flush system according to claim 27, further including a canister of compressed gas releasably mounted to the garment, said canister including means to open said canister and deliver the gas from the canister to said space during an emergency.

37. A flush system for a protective garment adapted to be worn by a person, comprising:

(a) a garment having a plurality of layers, a space being created between two adjacent layers;

(b) a source of compressed gas carried by a person;

(c) means for delivering gas from the source to the space; and (d) means for venting the gas from the space, wherein the means for delivering gas delivers gas at one end of the garment and the vent means is located at an opposite end of the garment to create gas flow through the garment.

38. The flush system according to claim 37, wherein said means for delivering continuously bleeds a small amount of gas to said space.

39. The flush system according to claim 37, wherein said means for delivering includes a valve operated by a person to control the flow of gas to the garment.

40. The flush system according to claim 37, wherein said garment comprises a jacket.

41. The flush system according to claim 37, wherein said garment comprises pants.

42. The flush system according to claim 37, wherein said garment includes an outer shell of flame resistant and abrasion resistant material; a moisture barrier layer and a thermal barrier layer.

43. The flush system according to claim 42, wherein said space is located between the thermal barrier layer and moisture barrier layer.

44. The flush system according to claim 42, wherein said space is located between the outer shell and moisture barrier.

45. The flush system according to claim 37, wherein a plurality of spacer elements are located in said space to create channels within said space for receiving the exhaled gas.

46. The flush system according to claim 37, further including a hose located in said space for receiving the exhaled gas, said hose including at least one aperture for venting air to said space.

47. The flush system according to claim 37, wherein the source of compressed gas is the tank of a self-contained breathing apparatus.

48. The flush system according to claim 37, wherein said garment includes a plurality of spaces located between adjacent ones of the plurality of layers, said means for delivering gas delivers gas to more than one of said plurality of spaces.

49. The flush system according to claim 37, further including a canister of compressed gas releasably mounted to the garment, said canister including means to open said canister and deliver the gas from the canister to said space during an emergency.

50. The flush system according to claim 37, further including means for delivering gas from said source to a face mask for inhalation by said person.

51. The flush system according to claim 50, wherein the means for delivering includes a flexible hose located in said space, said hose including an aperture for venting air to said space.

52. A flush system for a protective garment adapted to be worn by a person, comprising:

(a) a garment having a plurality of layers, a space being located between two of the layers;

(b) a source of compressed gas carried by a person;

(c) means for delivering gas from the source to a face mask for inhalation by a person; and (d) means for delivering gas exhaled by a person from the mask to the space, wherein the means for delivering gas exhaled includes a flexible hose, said hose being releasably attached to the garment.

53. The flush system according to claim 52, wherein the means for delivery includes means for delivering air from the source to a face mask worn by a person for inhalation, and means for delivering air exhaled by a person from the mask to the interior of the garment.

54. An air flush system for a firefighter's garment adapted to be worn by a firefighter comprising:

(a) a jacket having an outer shell of flame resistant and abrasive resistant material, a moisture barrier layer and a thermal barrier layer, and an air space located between two of said layers;

(b) a source of compressed air carried by a firefighter;

(c) a face mask;

(d) means for delivering air from the source to the mask for inhalation by a firefighter; and (e) means for delivering air exhaled by a firefighter to the air space, wherein the means for delivering air exhaled includes a flexible hose, said hose being releasably attached to the garment.

55. An air flush system for a firefighter's garment adapted to be worn by a firefighter comprising:

(a) a jacket having an outer shell of flame resistant and abrasive resistant material, a moisture barrier layer and a thermal barrier layer, and an air space located between two of said layers;

(b) a source of compressed air carried by a firefighter;

(c) a face mask;

(d) means for delivering air from the source to the mask for inhalation by a firefighter;

(e) means for delivering air exhaled by a firefighter to the air space; and (f) means for venting the air from the space, wherein the means for delivering exhaled air delivers air at one end of the garment and the vent means is located at an opposite end of the garment to create gas flow through the garment.

56. An air flush system for a protective garment adapted to be worn by a person, comprising:

(a) a garment having a plurality of layers, an air space located between two adjacent layers;

(b) a source of air carried by a person;

(c) means for delivering air from the source to a face mask worn by a person for inhalation by a person;

(d) means for delivering air exhaled by a person from the mask to the space; and (e) means for delivering air directly from the source to the garment, wherein the means for delivering air exhaled includes a flexible hose, said hose being releasably attached to the garment.

57. An air flush system for a protective garment adapted to be worn by a person, comprising:

(a) a garment having a plurality of layers, an air space located between two adjacent layers;

(b) a source of air carried by a person;

(c) means for delivering air from the source to a face mask worn by a person for inhalation by a person;

(d) means for delivering air exhaled by a person from the mask to the space;

(e) means for delivering air directly from the source to the garment; and (f) means for venting the air from the space, wherein the means for delivering exhaled air delivers air at one end of the garment and the vent means is located at an opposite end of the garment to create gas flow through the garment.

58. An air flush system for a protective garment to be worn by a person, comprising:

(a) a garment having a plurality of layers;

(b) a source of air carried by a person; and (c) means for delivering air from the source to the interior of the garment, wherein the means for delivering air includes a flexible hose, said hose being releasably attached to the garment.

* * * * *